US005581852A

United States Patent [19]

Zakrajsek

[11] Patent Number: 5,581,852

[45] Date of Patent: Dec. 10, 1996

[54] FASTENER ASSEMBLY

[75] Inventor: Jerry Zakrajsek, Fredonia, Wis.

[73] Assignee: DCI Marketing, Milwaukee, Wis.

[21] Appl. No.: 405,695

[22] Filed: Mar. 17, 1995

[51] Int. Cl.[6] ..... G09F 7/00; G09F 3/08

[52] U.S. Cl. ..... 24/289; 40/1.5; 40/591; 24/113 R

[58] Field of Search ..... 40/1.5, 1.6, 591, 40/308; 428/31; 24/289, 297, 358, 368, 379.1, 380, 104, 105, 113 R, 114.9, 458, 481, 482

[56] References Cited

U.S. PATENT DOCUMENTS

| | | | |
|---|---|---|---|
| 1,533,068 | 4/1925 | Martin | 40/591 |
| 1,876,405 | 9/1932 | Enscott | 40/591 X |
| 4,024,660 | 5/1977 | Goto | 40/308 |
| 4,597,206 | 7/1986 | Benson | 24/368 X |
| 4,691,457 | 9/1987 | Peroni | 40/1.5 X |
| 4,765,077 | 8/1988 | Rosenthal et al. | 40/308 |
| 5,027,537 | 7/1991 | Freeman et al. | 40/591 X |
| 5,363,575 | 11/1994 | Sawyer et al. | 40/308 |

*Primary Examiner*—Peter M. Cuomo
*Assistant Examiner*—Robert J. Sandy
*Attorney, Agent, or Firm*—Godfrey & Kahn, S.C.

[57] ABSTRACT

A fastener assembly for engaging a lattice-like structure, which includes a plurality of substantially horizontally oriented and vertically oriented components, and wherein the fastener assembly includes a first portion, a second portion which matingly interfits with the second portion thereby forming an assembled unit and which further includes individual portions which interact with at least one of the components of the lattice; an object of interest borne by the assembled unit and operable to be releasably secured on the assembled unit; and a fastener operable to engage the assembled unit and the object of interest thereby securing the assembled unit and the object of interest on the lattice-like structure.

23 Claims, 4 Drawing Sheets

FASTENER ASSEMBLY

BACKGROUND OF THE INVENTION

1. Field of the Invention

The present invention relates to a fastener assembly for fixing an object of interest to a second object of interest, and more particularly to a fastener assembly which is useful for releasably affixing an object of interest to a lattice-like structure.

2. Description of the Prior Art

The prior art is replete with numerous examples of assorted fasteners, each useful for a particular application. Typically, the specific application will determine the type of fastener chosen. For example, certain geometric structures prohibit the use of commonly used fasteners which employ rivets, screws and the like in view of the difficulties encountered in the installation of same. In particular, a lattice-like structure presents an unusually difficult geometry for the utilization of common fasteners.

As should be understood, contemporary fasteners are often difficult to install on assorted substrates or otherwise require special tools for the installation of same. Further, these same fasteners, under some circumstances, may damage the structure which they are affixed to. Additionally, fasteners which do not damage the underlying substrate or structure are often not reliable when exposed to adverse environmental conditions such as continuous vibration, extremes in temperature, exposure to U.V. radiation, and forcible impact, to name but a few.

As of late, certain manufacturers of luxury automobiles have engaged in numerous purchaser incentive programs which have endeavored to award their repeat customers with assorted distinctive indicia for use on their automobiles. Such an award may depict the number of automobiles purchased from that specific manufacturer. These awards may take on one of several forms, including emblems or badges which may be displayed prominently upon the grill of the automobile. As a general matter, these awards are highly prized by the owner of the automobile. To permit this emblem to be displayed on the grill of an automobile, it is necessary to utilize a fastener which will not damage the underlying lattice-like structure but will operate effectively to secure the emblem in place under adverse environmental conditions. Further, in view of the fact that the fastener will normally be installed by the purchaser of the automobile, it is essential that the fastener be easy to utilize. Furthermore, the fastener should have a design which discourages the theft of the emblem. In addition to the foregoing, the fastener should be of a design which requires only a minimum number of tools for installation. Still further, the fasteners should be of a design which makes the fastener inexpensive to manufacture. Lastly, the fastener must securely affix the emblem on the automobile grill in such a fashion that it does not vibrate, rattle or produce any unwanted noises under normal operational conditions.

Therefore, it has long been known that it would be desirable to have a fastener assembly which can be utilized to fasten an object of interest on a lattice-like structure and which simultaneously secures the object in a predetermined location, and yet does not damage the underlying structure, and which further can be easily installed, and which additionally is theft resistant, and cost effective to manufacture.

OBJECTS AND SUMMARY OF THE INVENTION

Therefore, it is an object of the present invention to provide an improved fastener assembly for fastening an object of interest to another object of interest.

A further object of the present invention is to provide a fastener assembly for fastening an object of interest to another object of interest, and which is characterized by ease of installation, simplicity of construction, and which further can be manufactured and sold at a nominal price.

A further object of the present invention is to provide a fastener assembly which is of a two piece construction, and wherein the individual pieces are operable to matingly interfit together in the manner of a snap-fit thereby forming an assembled unit which can be readily installed.

A further object of the present invention is to provide a fastener assembly for fastening an object of interest to another object of interest, and wherein the fastener assembly may be installed and later accessed from only one side of the object.

A further object of the present invention is to provide a fastener assembly for fastening an object of interest to another object of interest, and wherein the fastener assembly is manufactured of a rigid, resilient, yet corrosion resistant substance.

A further object of the present invention is to provide a fastener assembly for fastening an object of interest to another object of interest, and wherein the fastener assembly securely engages the first object of interest thereby inhibiting the vibration of the second object of interest.

A further object of the present invention is to provide a fastener assembly for fastening an object of interest to another object of interest, and wherein the fastener assembly will withstand prolonged exposure to adverse ambient environmental conditions without suffering failure.

A further object of the present invention is to provide a fastener assembly for fastening a first object of interest to a second object of interest, and wherein the fastener assembly provides deterrence to the theft or unauthorized removal of the second object of interest.

Further objects and advantages of the present invention are to provide improved elements and arrangements thereof in the fastener assembly for the purposes described and which is dependable, economical, durable and fully effective in accomplishing its intended purposes.

These and other objects and advantages are achieved in a fastener assembly which is operable to engage a lattice-like structure. The lattice-like structure includes a plurality of substantially horizontally and vertically oriented components, and the individual vertically and horizontally oriented components have opposite forwardly and rearwardly facing surfaces and further define individual spaces having predetermined dimensions therebetween. The fastener assembly includes a first portion which in operation is disposed in rested, bridging relation on the forwardly facing surface of an adjoining pair of horizontally oriented components. The first portion further includes first and second engagement members for matingly interfitting with the adjoining horizontally oriented components. The fastener assembly also includes a second portion operable to releasably and matingly interfit with the first portion, and the second portion includes a rearmost portion, an intermediate portion, and first and second engagement members. The first engagement member is operable to releasably and matingly interfit with the first portion, and is further made integral with the intermediate portion. The intermediate portion is made integral with the rearmost portion, and the second engagement member is borne by the rearmost portion and is operable to engage at least one of the vertically oriented components of the lattice-like structure.

The rearmost portion is disposed in a substantially normal attitude relative to the first portion. Substantially coaxial aligned apertures are formed in the first portion, first engagement member of the second portion, and rearmost portion of the second portion, respectively, and the first and second portions form an assembled unit when disposed in interfitted mating engagement, one with the other. An object of interest is borne by the assembled unit and operable to be positioned in a predetermined orientation relative to the lattice-like structure. A fastener, operable to engage the assembled unit and the object of interest, is received in the coaxial aligned apertures and is operable to screwthreadably secure the object of interest on the lattice-like structure.

These and other objects and advantages of the present invention will become more apparent from the following detailed description of the preferred embodiment of the present invention taken in combination with the accompanying drawings.

DESCRIPTION OF THE PREFERRED EMBODIMENT

Figure 4:
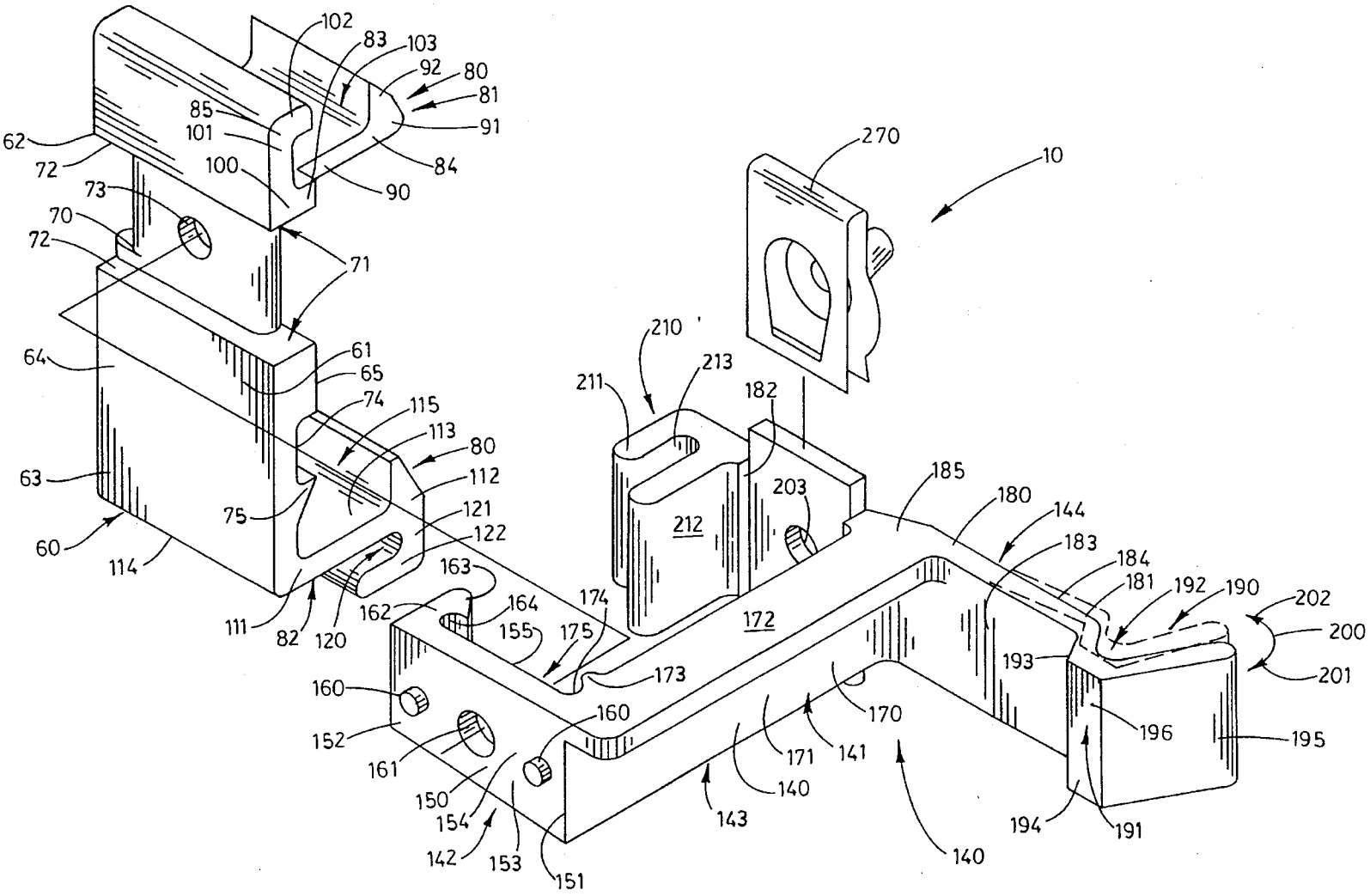
FIG. 4 is greatly enlarged exploded, perspective view of the fastener assembly of the present invention.

Referring more particularly to the drawings, the fastener assembly of the present invention is designated generally by the numeral 10 and is best appreciated by a study of FIG. 4. The fastener assembly 10 is operable to interact or be connected to an object of interest 12 which is illustrated herein as an automotive grill, although it will be recognized that the fastener assembly 10 may be utilized in combination with other types of lattice-like structures.

Figure 1:
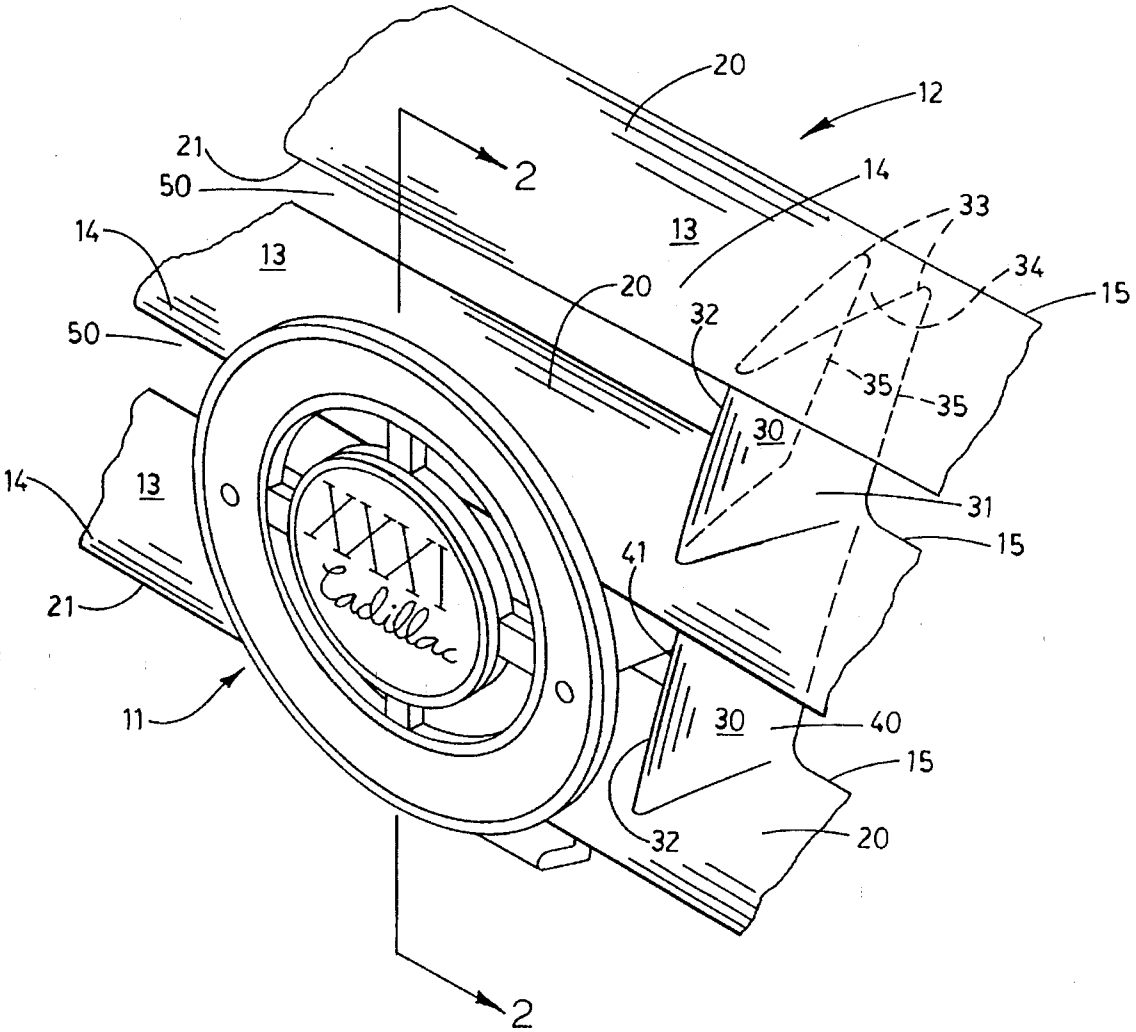
FIG. 1 is a partial, perspective, environmental view of the fastener assembly of the present invention, and which is shown in combination with a decorative ornament for use on an automotive grill of conventional design.

The automobile grill 12 is positioned on the front end of an automobile (not shown). The grill 12 has a lattice-like geometry and consists of a plurality of substantially horizontally oriented and equally spaced components 13. Each of these components 13 includes a leading edge or forwardly facing surface 14 and a rearwardly facing or trailing edge 15. In addition, each of the substantially horizontally oriented components 13 possess an upper facing surface 20, and a lower facing surface 21. The automobile grill also includes a plurality of substantially vertically oriented and equally spaced components 30. Each of the vertically oriented and equally spaced components 30 has a main body 31, which includes a leading edge or forwardly facing surface 32, and a pair of legs which are generally designated by the numerals 33. The individual legs form a "Y" shape when viewed along the longitudinal axis of the individual vertical components. This is best seen in FIG. 1. The individual legs define a gap or space 34 therebetween. Further, each of the legs possesses a substantially vertically oriented trailing edge or rearwardly facing surface 35. In addition to the foregoing, the individual legs include exterior facing surfaces 40 and 41, respectively. The individual vertical components intersect with each of the horizontal components thereby forming a plurality of generally rectangular interstices or spaces 50 which individually permit air flow to the radiator of the automobile (not shown).

The fastener assembly 10 of the present invention includes a first portion which is generally indicated by the numeral 60, and which includes a main body generally designated by the numeral 61. As best seen by reference to FIGS. 3 and 4, the main body includes first and second ends 62 and 63, respectively, and forwardly and rearwardly facing surfaces 64 and 65, respectively. The main body further includes an intermediate portion 70 which has formed therein a channel 71. The channel 71 has a predetermined shape and further is nonuniform in its width dimension. The intermediate portion further has reduced length and width dimensions in relative comparison to the main body 61. The channel 71 is defined by horizontally oriented peripheral edges which are generally indicated by numeral 72. Further, an aperture 73 is formed in the main body 61 end is positioned in the intermediate portion 70. A second channel 74 is formed in the rearwardly facing surface 65 and is oriented substantially transversely relative to the longitudinal axis of the main body 61. The rearwardly facing surface 65 further includes a lip 75.

The first portion 60 includes a pair of engagement members 80. The pair of engagement members includes a first engagement member 81 and a second engagement member 82. The first engagement member 81 has a main body 83 which includes a first, substantially normally disposed course 84, and a second substantially parallel oriented course 85. The first course 84 has a first end 90 which is made integral with the main body 61 and further has an opposite, second end 91. Made integral with the second end 91 is a lip 92. Additionally, the second course 85 has a first end 100, and an opposite second end 101. Further, a lip 102 is mounted on the second end and thereby defines a receiving station 103 between the individual lips 92 and 102, respectively.

Figure 2:
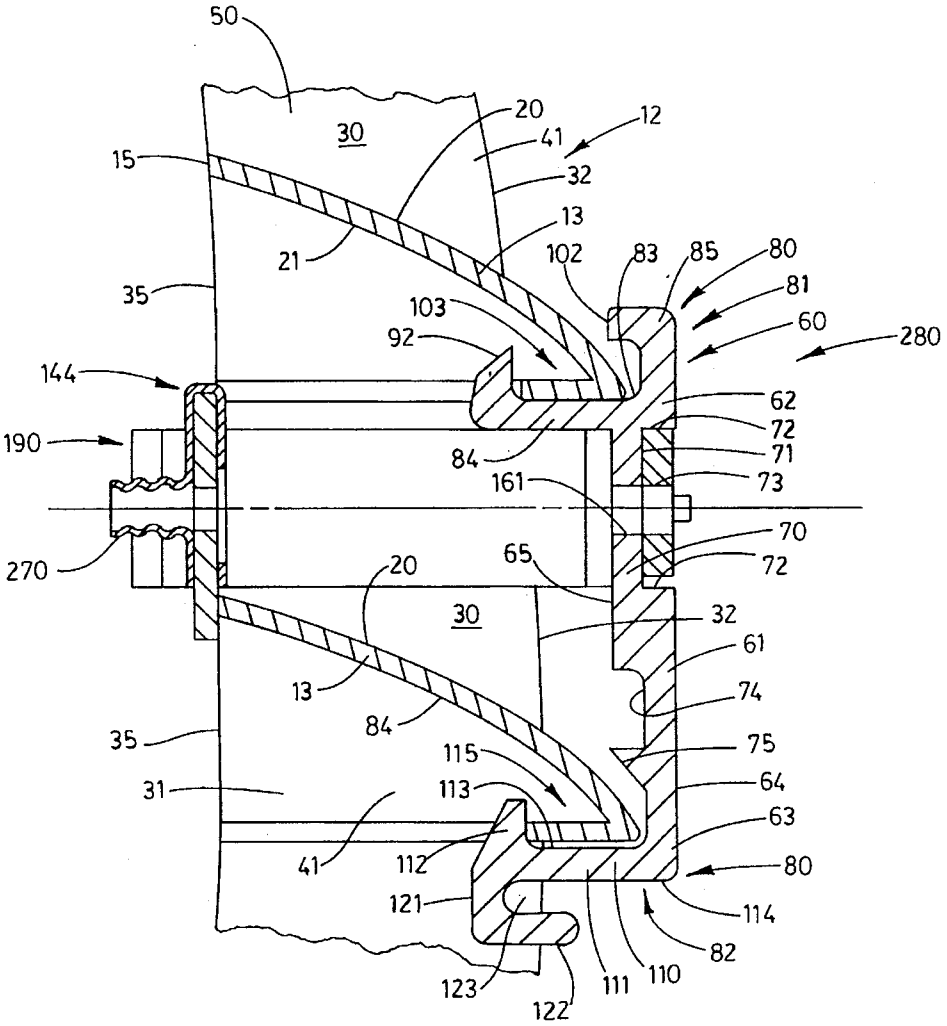
FIG. 2 is a fragmentary, transverse, vertical, cross-sectional view of the fastener assembly of the present invention, and which is taken from a position along line 2—2 of FIG. 1, and which further illustrates the fastener assembly of the present invention in an operational position relative to the lattice-like structure of an automotive grill.

As best seen by reference to FIG. 2, the second engagement member 82 has a main body 110 which has a first, substantially normally oriented course 111 and a second substantially parallel oriented course 112. The first and second courses are made integral one with the other thereby defining a second receiving station 115 therebetween. The main body 110 of the second engagement 82 has a tool engagement slot 120 made integral therewith. The tool engagement slot is defined by first and second courses 121 and 122, respectively. A space 123 is defined by the second course 122 and the first course 111. The space 123 has a length and width dimension which will accommodate the tip of a flat-head screwdriver (not shown). A screwdriver may be placed in the tool engagement slot and may be utilized to apply torque to the first portion 60 thereby disengaging it from the lattice-like structure.

As best seen by reference to FIG. 4, end as best imagined by a study of FIG. 2, the fastener assembly 10 of the present invention has a second portion which is generally designated by the numeral 140, and which is operable to releasably interfit in mating engagement with the first portion 60. The second portion 140 includes a main body 141 which is defined by a first course, or first engagement member 142; a second course or intermediate portion 143, and a third course, or rearmost portion 144.

The first course or first engagement member 142 has a main body 150, and further has a first end 151 and an opposite second end 152. As best seen by reference to FIG. 3, the main body includes a first component 153. The first component has a forwardly facing surface 154 and an opposite rearwardly facing surface 155. A pair of orientation members 160 is fixed on the forwardly facing surface 154. The members 160 are disposed in substantial normal relationship relative thereto. Additionally, an aperture 161 is formed in the main body of 150 and is operable to be substantially coaxial aligned relative to the aperture 73 which is formed in the first portion 60. As can best be appreciated by reference to FIGS. 2 and 3, the main body 150 further has a second component 162, which is disposed substantially normally relative to the first component and which further has a nipple or protrusion 163 formed thereon. In addition, a channel 164 having predetermined dimensions is further formed in the second component 162.

The second course, or intermediate portion 143 is made integral With the first course or first engagement member 142. The second course has a main body 170 which includes a first component 171 and a second component 172 which are disposed in substantial normal relation one to the other, thereby providing a ridged member. As will be appreciated by a study of FIG. 2, the length of the main body 170 is substantially equal to or slightly greater than the dimension of the vertical component of the lattice-like structure. Further, and as best seen by reference to FIG. 3, a nipple or protrusion 173 is formed on the first component 171 and is disposed in a position adjacent to a channel 174 which is also formed in the same surface. The individual nipples 173 and 163 define a predetermined gap or space which provides a convenient means for providing a snap-fit arrangement such that the channel 71 may be received in the channel 164. The intermediate portion 70 of the first portion 60 is operable to be releasably captured between the nipples 163 and 173, respectively. The channel 70 is shaped such that it may be matingly received in the main body 150 of the first engagement member 143. This inhibits misorientation of the first and second portions. Stated in other terms, the first and second portions can only be assembled in one orientation, thereby inhibiting misassembly. As noted above, the individual nipples 163 and 173 provide a means for a snap-fit arrangement between the first and second portions. They further define a receiving station 175 therebetween.

The third course or rearmost portion 144 includes a main body 180 which has a first end 181 and an opposite, second end 182. Further, the main body 180 has a forwardly facing surface 183 and an opposite rearwardly facing surface 184. As best seen by reference to FIG. 4, the second course of intermediate portion 143 is made integral with the main body 180 at a substantially intermediate portion 185. Mounted on the first end 181 of the main body 180, is a second engagement member 190. The second engagement member has a forwardly facing engagement or camming surface 191 and an opposite, rearwardly facing surface 192. The second engagement member includes first, second, and third components which are generally indicated by the numerals 193, 194, and 195, respectively. The individual components are disposed in fixed angulated relation one to the other, thereby defining a forwardly oriented nipple or protrusion 196. As should be understood, the fastener assembly 10 is manufactured from a resilient material such as a synthetic polymer which may be molded. In this regard, it should be understood that the second engagement member 190 is operable to move along a substantially arcuately shaped path of travel from a first or rest position 201 to a second stressed or distorted position 202, which is shown in phantom lines. The resiliency of the material permits the protrusion 196 to pass by the main body 31 of one of the vertically oriented components 30 and thereby be received or captured in the gap 34 which is defined by the individual pair of legs 33. This action is in the manner of a snap-fit. As best seen by reference to FIG. 4, an aperture 203 is formed in the second end 182 of the main body 180. When the first portion 60 is properly engaged with the second portion 140, the individual apertures formed in the first and second portions are oriented in substantially coaxial alignment, one with the other.

As best illustrated by reference to FIG. 4, a tool engagement member 210 is made integral with the second end 182 of the main body 180. The tool engagement member includes a first component 211 and a second component 212. The first and second components are disposed in spaced, substantially parallel relation, one to other, and thereby define a space or gap 213 therebetween. The gap has predetermined dimensions and will accommodate a flathead screwdriver tip (not shown). The tool engagement member operates in a manner similar to that earlier described with respect to the first portion 60, that is, torque applied by a screwdriver may be operable to disengage the second portion 140 from the lattice-like structure and more specifically one of the vertically oriented components thereof.

As noted earlier, the fastener assembly 10 of the present invention finds particular utility in mounting a second object of interest 220 on the first object of interest 12. The second object of interest 220 includes a first plate 230 which has a forwardly disposed surface 233, and a rearwardly disposed surface (not shown). The first plate has a centrally disposed aperture 231 formed therein. In addition, the first plate has three locking apertures 232 formed therein which are radially disposed in a predetermined pattern about the centrally disposed aperture 231 of the first plate. The plate also has formed therein a pair of orientation tab receiving apertures 235 which are spaced a predetermined distance from the centrally disposed aperture of the first plate and are operable to matingly receive in interfitted relation the individual orientation members 160. The third plate further includes a beveled recess 236 which is formed in the forwardly facing surface at a predetermined distance from the aperture 231.

Figure 3:
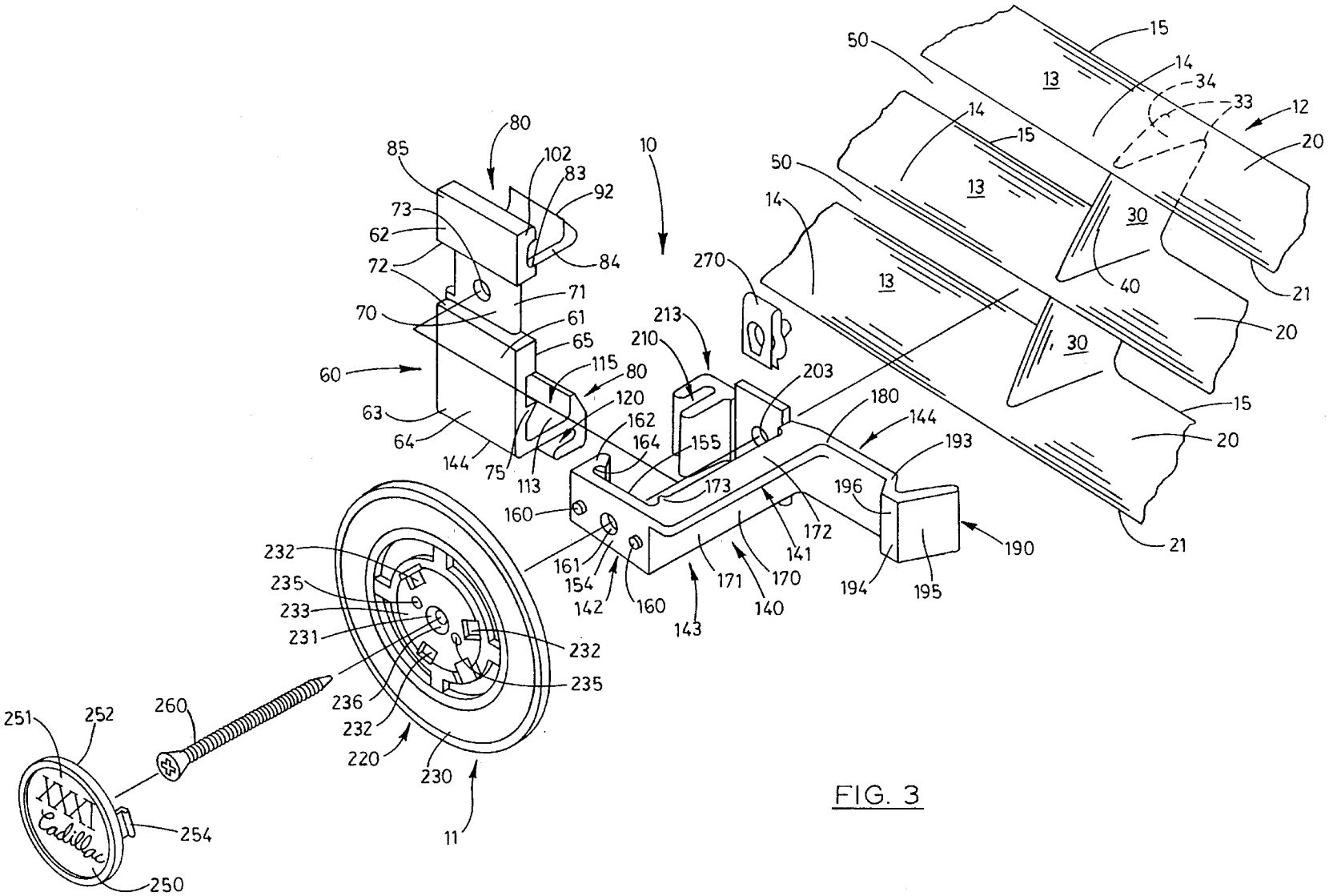
FIG. 3 is a fragmentary, exploded, perspective, environmental view of the fastener assembly of the present invention.

As best seen by reference to FIG. 3, the second object of interest 220 includes a second plate 250 which is operable to matingly engage in snap-fitted relation the first plate 230. The second plate 250 has a forwardly facing surface 251 and a rearwardly facing surface 252. As best seen by a study of FIG. 3, the rearwardly facing surface further has a recess formed therein which is operable to receive the head of a fastener which will be discussed in greater detail hereinafter. Extending substantially normally outwardly relative to the rearwardly facing surface 252 are three locking tabs 254 (only one of which is shown) which are radially disposed in a predetermined pattern about the recess. The locking tabs are generally hook-shaped and have predetermined dimensions which permit them to individually matingly snap-fit into releasable interfitted engagement with the first plate by means of the respective locking apertures 232. Additionally, an adhesive pad (not shown) may be positioned in sandwiched relationship between the first and second plates, adhesively securing the first and second plates together. This is best imagined by a study of FIGS. 1 and 3. The forwardly facing surface 251 of the second plate can be printed or embossed with all manner of indicia as needed by the manufacturer of the automobile to indicate any particular award or number of automobiles purchased. The second plate further includes a beveled recess (not shown) which is formed in the rearwardly facing surface 252 and which is operable to be aligned with the recess 236 which is formed in the first plate 230.

As best seen by reference to FIG. 3, a threaded fastener 260 is operable to be screwthreadably received in the coaxially aligned apertures 73, 161, and 203, respectively. Further, and as best seen by reference to FIG. 4, a metal clip 270 slidably and matingly interfits with the rearmost portion 144 and is operable to screwthreadably mate with the threaded fastener. The clip is matingly received between one of the tool engagement members 212 and the intermediate portion 143. This is best seen by reference to FIG. 4. The clip is threadably engaged by the threaded fasteners, thereby securing the object of interest on the fastener assembly 10.

OPERATION

The fastener assembly 10 of the present invention is operable to engage a lattice-like structure 12 which includes a plurality of substantially horizontally and vertically oriented components 13 and 30, respectively. The horizontally and vertically oriented components define interstices or spaces 50 therebetween. As noted earlier, the fastener assembly includes a first portion 60 and a second portion 140 which is operable to matingly interfit with the first portion thereby forming an assembled unit 280. The assembled unit 280 includes individual portions which interact with at least one of the components of the lattice-like structure. An object of interest 230 as borne on the assembled unit is operable to be releasably secured to the assembled unit, and a fastener 280 is operable to engage the assembled unit and the object of interest 230 thereby securing the assembled unit and the object of interest on the lattice-like structure.

More specifically, the fastener assembly 10 for engaging a lattice-like structure 12 includes a first portion 60 which is disposed in a predetermined orientation and which is operable to engage at least one of the horizontally oriented components 13. The first portion further includes an intermediate portion 70 which defines a channel 71 which is disposed in a predetermined position, and which further has a predetermined shape. The second portion 140 is disposed in substantial normal orientation relative to the first portion, and further includes a first engagement member 142 which is operable to matingly and releasably interfit with the channel 71 of the first portion in the manner of a snap-fit, thereby forming an assembled unit 280. The second portion is operable to engage at least one of the vertical components 30 of the lattice-like structure. As best seen by reference to FIG. 2, the first portion is disposed in rested, bridging relation on the forwardly facing surfaces 14 of adjoining horizontally oriented components 13. The first portion further includes first and second engagement members 81 and 82, respectively, which are operable for mating interfitting relation relative to the adjoining horizontal components. This is seen in FIG. 2 where the individual horizontal components are engaged or otherwise captured in the individual receiving stations 103 and 115, respectively. The second portion includes a rearmost portion 144, an intermediate portion 143, and first and second engagement members 142 and 190, respectively. The first engagement member 142 is operable to releasably and matingly interfit with the first portion 60 and is further made integral with the intermediate portion 143. Still further, the intermediate portion is made integral with the rearmost portion 144 and the second engagement member 190 is borne by the rearmost portion and is operable to engage at least one of the vertically oriented components 30. The first and second portions have individual substantially coaxial aligned apertures which are operable to receive a threaded fastener 200 therein and which secures the object of interest on the fastener assembly 10.

The assembled unit 280 is installed as follows. Following the proper orientation of the first and second portions 60 and 140, one to the other, the individual portions are pressed into mating engagement in the manner of a snap-fit when the intermediate portion 70 of the first portion is received between the nipples 163 and 173, respectively. When this event occurs the individual apertures 72, 167, and 203, respectively, which are formed in the first and second portions are disposed in substantial coaxial alignment. The installer (not shown) thereafter moves the assembled unit 280 through one of the interstices 50 to a position where the horizontal components are matingly received in the individual receiving stations 103 and 115, respectively. To achieve this orientation, it should be understood that the individual components 84 and 111, respectively, must be deformed thereby permitting the horizontal component to be received in the individual receiving stations.

Once this event occurs, the installer merely applies physical force to the assembled unit 280 in a direction whereby the second engagement member 190 is urged into forcible engagement relative to one of the vertically oriented components 30. As force is applied, the forwardly facing engagement or camming surface 191 causes the main body 180 to move along the arcuately shaped path of travel 200 from the first position 201 to the second position 203. When this event occurs, the nipple or protrusion 196 slips or passes into the space or gap 34 which is defined between the pair of legs 33 in the manner of a snap-fit. At this point, the fastener assembly is secured against movement in both vertical and horizontal directions.

Before installation, a metal clip 270 is slideably received on the main body 180 of the rearmost portion 144. As earlier discussed the clip is operable to threadably mate with the fastener 260.

Following these events the first plate 230 is disposed in an appropriate position, such that the pair of orientation members 160 are mating received in the individual receiving apertures 235. This positions the plate in an appropriate orientation to receive the second plate 250. As earlier discussed, the second plate is disposed in an orientation such that the locking tabs 254 are received in the individual locking apertures 232. The second plate is then pressed into engagement with the first plate in the manner of a snap-fit. Prior to the engagement of the first and second plates into snap-fitted engagement, a threaded fastener is received in the individual coaxial aligned apertures and through the central aperture 231. As should be understood, the threaded fastener engages the metal clip 270 thereby securing the first plate 230 on the fastener assembly 10. As noted above, the second plate is forced into snap-fitted engagement relative to the first plate thereby hiding the head of the fastener.

Removal of the fastener assembly 10 from the lattice-like structure follows approximately the reverse of what has been discussed above with the exception that a prying tool (not shown) such as a flat head screwdriver will be used. For example, to remove the second plate 250 a screwdriver (now shown) would be inserted in a small space (not shown) which is created when the individual plates are pressed together. Force would be applied to same, thereby detaching the first and second plates 230 and 250, respectively. Once the second plate is removed the screwdriver would be employed to threadably disengage the threaded fastener 260 from the main bodies 61 and 141 of the fastener assembly. Following this step the screwdriver would be inserted in the tool engagement member 210. Torque would then be applied to same thereby causing the second engagement member 190 to move out of receiving engagement relative to one of the vertically oriented components 30. After this step is achieved, a screwdriver would be inserted into the tool engagement slot 120. Torque would then be applied to same, thereby removing the first portion from the adjoining horizontal components 13.

Although the invention has been herein shown and described in what has conceived to be the most practical and preferred embodiment, it is recognized that departures may be made therefrom within the scope of the invention, and is not to be limited to the illustrative details disclosed.

Having described my new invention, what I claim as new and desire to secure by Letters Patent of the United States is:

1. A fastener assembly for engaging a lattice-like structure, the lattice-like structure including a plurality of substantially horizontally oriented components and a plurality of substantially vertically oriented components, and wherein the horizontal and vertical components define spaces therebetween, the fastener assembly comprising;

a first portion;

a second portion which interfits with the first portion thereby forming an assembled unit, and wherein the assembled unit includes individual portions which interact with at least one of the components of the lattice-like structure;

an object of interest borne by the assembled unit and operable to be releasably secured on the assembled unit; and a fastener operable to engage the assembled unit and the object of interest thereby securing the assembled unit and the object of interest on the lattice-like structure, and wherein the first portion includes a main body having first and second ends and forwardly and rearwardly facing surfaces, and wherein the main body further includes first and second lattice engaging members, and wherein the first lattice engaging member is borne on the first end of the main body and has first and second courses, and wherein the first course includes a hook-shaped engagement member, and the second course extends normally outwardly relative to the first course and defines a receiving station therebetween, and wherein the second lattice engaging member includes individual first and second courses, and wherein the first course extends normally outwardly relative to the rear surface at the second end of the main body, and the second course extends normally outwardly relative to the second course thereby defining a second receiving station, and wherein the main body further has an intermediate portion which has a reduced width and thickness dimension thereby defining an engagement channel.

2. A fastener assembly as claimed in claim 1, and wherein the second portion includes first, second, and third courses, and wherein the first course includes first and second end and a midpoint therebetween, and wherein the first course further includes an aperture formed therein which is disposed substantially intermediate the first and second ends, and wherein the second course includes first and second ends, and wherein the first end of the second course is affixed to the second end of the first course, and wherein the second course is oriented substantially normally relative to the first course, and wherein the third course has first and second ends and a midpoint therebetween, and wherein the third course is fixed on the second end of the second course and is disposed substantially normally relative thereto, and wherein the first course is matingly received in the manner of snap-fit in the engagement channel defined by the main body of the first portion.

3. A fastener assembly as claimed in claim 2, and wherein the main body of the first portion has an aperture formed therein in the area of the engagement channel, and wherein the apertures of the first and second portions are disposed in substantially coaxial alignment when the first and second portions are disposed in snap-fitted engagement, and wherein fastener is received in the coaxial aligned apertures and is thereby rendered operable to secure the object of interest to the fastener assembly.

4. A fastener assembly as claimed in claim 3, and wherein the fastener is a threaded fastener.

5. A fastener assembly as claimed in claim 4, and wherein the first and second portions are manufactured from a substantially resilient material.

6. A fastener assembly as claimed in claim 5, and wherein the main body of the first portion further defines a first slot which receives a prying tool, and wherein force applied by the prying tool to the first portion provides sufficient torque to disengage the first portion of the assembled unit from the lattice-like structure.

7. A fastener assembly as claimed in claim 6, and wherein the second portion further includes a second slot for receiving a prying tool, and wherein force applied by the prying tool to the second portion provides sufficient torque to disengage the second portion from the lattice-like structure.

8. A fastener assembly as claimed in claim 7, and where in the second portion further includes an orientation channel, and wherein a fastener engaging clip is received in the orientation channel and is disposed in substantially coaxial alignment relative to individual coaxially aligned aperture.

9. A fastener assembly as claimed in claim 8, and wherein a camming surface is borne on the second portion and is oriented for engagement with one of the vertical components of the lattice structure.

10. A fastener assembly as claimed in claim 9, and wherein the object of interest includes first and second plates, and wherein the first plate has a centrally disposed aperture formed therein which is operable to receive the fastener, and wherein the first plate further includes a plurality of locking apertures, and wherein the second plate includes a plurality of locking tabs which releasably mate with the individual locking apertures thereby securing the first and second plates together, and wherein the first plate and first portion releasably mate, one with the other, thereby orienting the first plate in a predetermined position relative to the first portion.

11. A fastener assembly as claimed in claim 10, and wherein an adhesive is applied between the first and second plates.

12. A fastener assembly for engaging a lattice-like structure, and which includes a plurality of substantially horizontally and vertically oriented components, and wherein the individual horizontal and vertical components define predetermined spaces therebetween, the fastener assembly comprising:

a first portion disposed in a predetermined orientation and operable to engage at least one of the horizontally oriented components, and wherein the first portion further includes an intermediate portion which defines a channel;

a second portion disposed in a substantially normal orientation relative to the first portion and including an engagement member which is operable to matingly interfit the channel of the first portion in the manner of a snap-fit thereby forming an assembled unit, and wherein the second portion is operable to engage at least one of the vertical components of the lattice-like structure;

an object of interest borne by the assembled unit and operable to be releasably secured on the assembled unit; and a fastener operable to releasably engage the assembled unit and the object of interest thereby securing the object of interest and the assembled unit on the lattice-like structure.

13. A fastener assembly as claimed in claim 12, and wherein the lattice-like structure includes forwardly and rearwardly facing surfaces, and wherein the first portion is disposed in bridging relation relative to a pair of adjoining horizontally oriented components and on the forwardly facing surfaces thereof, and wherein the second portion has a second engagement member which is operable to releasably engage the rearwardly facing surface of at least one of the vertically oriented components.

14. A fastener assembly as claimed in claim 13, and wherein the first portion includes a main body having opposite first and second ends, and wherein the main body includes first and second engagement members which are individually operable to engage the adjoining horizontally oriented components, and wherein individual apertures are formed in the first and second portions and oriented in substantially coaxial alignment, and wherein the fastener is operable to be received in the coaxial aligned apertures thereby securing the object of interest on the assembled unit.

15. The fastener assembly as claimed in claim 14, and wherein the first and second engagement members of the first portion define individual receiving stations for matingly interfitting with the individual adjoining horizontal components, and wherein the first portion further includes a tool engagement slot which facilitates removal of the first portion from the horizontally oriented components.

16. The fastener assembly as claimed in claim 15, and wherein the horizontally oriented components have a predetermined width dimension, and wherein the second portion further includes a rearmost portion and an intermediate portion, and wherein the rearmost portion is oriented in substantially parallel relation relative to the horizontal component, and wherein the intermediate portion is made integral with the rearmost portion and extends normally forwardly relative thereto, and wherein the engagement member of the second portion is made integral with the intermediate portion and is disposed in a substantially normal attitude relative thereto.

17. A fastener assembly as claimed in claim 16 and wherein the second portion includes a tool engagement slot which facilitates removal of the second portion from the vertically oriented component of the lattice-like structure, and wherein a fastener engagement member is operable to matingly interfit with the second portion and is disposed in substantially coaxial alignment relative to the apertures thereby screwthreadably receiving the fastener.

18. A fastener assembly as claimed in claim 15, and wherein the engagement member of the second portion has a forwardly facing surface, and wherein an orientation member is borne by the forwardly facing surface and is operable to engage the object of interest thereby orienting the object of interest in a specific position relative to the lattice-like structure.

19. A fastener assembly as claimed in claim 18, and wherein the second engagement member of the second portion is borne by the rearmost portion and is disposed remotely relative to the tool engagement slot thereof.

20. A fastener assembly for engaging a lattice-like structure which includes a plurality of substantially horizontally and vertically oriented components, and wherein the individual vertically and horizontally oriented components have opposite forwardly and rearwardly facing surfaces, and further define spaces having predetermined dimensions therebetween, the fastener assembly comprising:

a first portion disposed in rested, bridging relation on the forwardly facing surfaces of an adjoining pair of horizontally oriented components, and wherein the first portion further includes first and second engagement members for matingly interfitting with the individual adjoining horizontally oriented components;

a second portion operable to releasably and matingly interfit with the first portion, and wherein the second portion includes a rearmost portion, an intermediate portion, and first and second engagement members, and wherein the first engagement member releasably and matingly interfits with the first portion and is further made integral with the intermediate portion, and wherein the intermediate portion is made integral with the rearmost portion, and wherein the second engagement member is borne by the rearmost portion and is operable to engage at least one of the vertically oriented components, and wherein the rearmost portion is disposed in a substantially normal orientation relative to the first portion, and wherein individual, substantially coaxial aligned apertures are formed in the first portion, the first engagement member of the second portion and the rearmost portion of the second portion, respectively, and wherein the first and second portions form an assembled unit when disposed in fitted mating engagement with each other;

an object of interest borne by the assembled unit and operable to be positioned in a predetermined orientation relative to the lattice-like structure; and a fastener operable to engage the assembled unit and the object of interest, and wherein the fastener is received in the coaxial aligned apertures and is operable to screwthreadably secure the object of interest on the lattice-like structure.

21. A fastener assembly for fastening an object of interest on a lattice-like structure, the lattice-like structure including a plurality of vertically oriented lattice components, each of which has a pair of legs which define a gap, and a plurality of horizontally oriented lattice components, the fastener assembly comprising:

a first portion having at least one engagement member operable to matingly interfit with one of the plurality of horizontally oriented lattice components; and a second portion releasably engagable with the first portion and operable to engage at least one of the plurality of vertically oriented lattice components by means of an engagement member which snap-fits in the gap between the legs of the at least one vertically oriented lattice component.

22. A fastener assembly as claimed in claim 21, wherein the first portion further comprises a second engagement member operable to matingly interfit with one of the plurality of horizontally oriented lattice components.

23. A fastener assembly as claimed in claim 22, further comprising a fastener for engaging the object of interest and for securing same on the fastener assembly.

* * * * *